US007384353B2

(12) United States Patent
Lipidarov

(10) Patent No.: US 7,384,353 B2
(45) Date of Patent: Jun. 10, 2008

(54) HIGH PERFORMANCE FLEXIBLE GOLF BALL TEE APPARATUS

(76) Inventor: Peter Lipidarov, 11224 Linden La., Port Richey, FL (US) 34668

( * ) Notice: Subject to any disclaimer, the term of this patent is extended or adjusted under 35 U.S.C. 154(b) by 0 days.

(21) Appl. No.: 11/199,540

(22) Filed: Aug. 8, 2005

(65) Prior Publication Data

US 2007/0032316 A1 Feb. 8, 2007

(51) Int. Cl.
*A63B 69/36* (2006.01)

(52) U.S. Cl. ..... 473/392

(58) Field of Classification Search ..... 473/387–403
See application file for complete search history.

(56) References Cited

U.S. PATENT DOCUMENTS 1,542,514 A * 6/1925 Mahony ..... 473/390
1,617,232 A * 2/1927 Butler et al. ..... 473/392
1,779,995 A * 10/1930 Trane ..... 473/398
1,936,625 A * 11/1933 Goldman ..... 473/398
2,079,387 A * 5/1937 Sickmiller ..... 473/398
2,146,736 A 2/1939 Hammond et al.
2,661,213 A * 12/1953 Barnard ..... 473/394
3,966,214 A 6/1976 Collins
5,156,403 A 10/1992 Martino
5,301,950 A 4/1994 Patterson
5,492,323 A 2/1996 Lee
6,932,277 B1 * 8/2005 Ericksen et al. ..... 239/1

* cited by examiner

*Primary Examiner*—Steven Wong
(74) *Attorney, Agent, or Firm*—Ronald E. Smith; Smith & Hopen, P.A.

(57) ABSTRACT

A high performance flexible golf ball tee apparatus specially designed for golf practice, said tee has a stake (24) that is fitted and a base (22) that has a cylinder (20) on one end. Said base (22) has a slot (32) that is fitted, opposite the cylinder. The slot (32) allows the stake (24) to penetrate through the base (22) and into the ground, holding the whole apparatus in place and not letting it rotate, allowing this apparatus to remain in place so that a person can strike a golf ball with a golf club repeatedly from this tee without having the tee break off or fly onto the golf driving range, avoiding consistent replacement of a conventional golf tee.

5 Claims, 5 Drawing Sheets

HIGH PERFORMANCE FLEXIBLE GOLF BALL TEE APPARATUS

BACKGROUND OF THE INVENTION

1. Field of Invention

This invention relates to golf tees, more particularly to a high performance flexible golf ball tee that is used mainly for golf practice.

2. Prior Art

Since golf was first introduced more than a century ago, it has achieved great development that we see today. The sport commands a great number of followers and is loved by many all over the world. It is this passion for the game that drives the development, invention and innovation for many great golfing products. Over the years, inventors have introduced different tees hoping to replace the conventional wooden tee. Two examples of this are U.S. Pat. No. 2,146,736 to Hammond (1936) and U.S. Pat. No. 3,966,214 to Collins (1976). These are unique inventions that try to solve the problem with tees flying away from the player. However, these products themselves fall short and when they are placed into the ground, then struck with a golf club they too, also fly away from the player. They have a head portion that pivots or swivels but that alone does not help them to stay in the ground when struck by a golf club. However, these innovations has not made much progress in solving a long existing problem. They fell short of their expectations, never becoming popularized. These inventions are also more complex and more expensive to make in comparison to the conventional wooden tee.

That is why I created my flexible tee but I can not compare my tee to a conventional wooden tee or the like because it is not a tee used on a golf course for teeing off. My tee is used to practice on a driving range or for practice anywhere. Therefore, there is a real need to have a golf tee to use repeatedly for practice without breakage or loss of the tee. Thus, overcoming the deficiencies of the conventional tees now in existence that are used on golf driving/practice ranges.

BACKGROUND OF THE INVENTION—OBJECTS AND ADVANTAGES

The object and advantage of the present invention is to provide a flexible golf ball support that is designed for golf practice which consists of a vertical soft flexible cylinder that holds a golf ball up so it can be struck repeatedly by a golf club. Also allowing it to flex in the direction of the golf club swing on impact without breaking or being removed from its stationary position. The cylinders soft flexible material will not damage the face of a golf club and is made in various heights to adjust to any size golf club.

A current object and advantage is my tee has a soft flexible base that holds the cylinder upright, so when the cylinder is struck by a golf club the base will also flex. This will help with the high impact of a golf club allowing this flexible base to flex in the direction of the golf club swing which creates less pressure on the stake, making it harder to work itself out of the ground, thus keeping the tee in its stationary position.

A further object and advantage of my flexible tee apparatus is the stake. It will hold its position in the ground because of its unique designs. Also, the stake and base are fitted which allows the stake when anchored into the ground to be able to hold the base in a position not allowing the base to rotate allowing the tee to stay in its stationary position.

All the components combined make this an extremely practical and much needed tee apparatus for golf practice.

SUMMARY

In accordance with the present invention, a flexible golf ball tee apparatus comprises a cylinder that holds a golf ball up, which is on one end of the base. The base has a slot that is opposite of the cylinder and is fitted, so a stake that is fitted can penetrate the base through the slot.

More particularly, the novel golf tee includes an elongate, flat, flexible base adapted to overlie a support surface. The flexible base has a longitudinal axis of symmetry, a first end having a first thickness, a second end longitudinally spaced from the first end and having a thickness substantially equal to the first thickness, and a medial section formed integrally with the first and second ends. The medial section has a thickness that is less than the thickness of the first and second ends.

The cylinder is a flexible, cylindrical tee secured to the first end of the flexible base in upstanding relation thereto. The cylindrical tee is centered on the longitudinal axis of symmetry.

The slot is a non-circular aperture formed in the second end of the flexible base, and the non-circular aperture is centered on the longitudinal axis of symmetry in longitudinally spaced relation to the flexible, cylindrical tee.

The stake has a cross-section conforming to the non-circular aperture. The stake is adapted to be driven into the support surface through the non-circular aperture. Accordingly, if a golf club head strikes the flexible tee, the medial section of the flexible base will flex so tat the flexible tee and the first end of the flexible base will momentarily be lifted from the support surface so that the force of the impact is not fully transferred to the second end of the flexible base so that the second end remains in non-sliding contact with the support surface due to the stake. The flexible base does not rotate about the stake when the first end of the flexible base is momentarily lifted due to the respective structures of the non-circular aperture and the non-circular stake.

A plurality of truncate support members is disposed in depending relation to an underside of the medial section of the flexible base to prevent sagging of the medial section wit respect to the first and second ends of the flexible base.

The first end of the flexible base has a first width, the second end of the flexible base has a second width, and the first width is greater than the second width. The medial section has a width that tapers from the first width to the second width.

The stake has a head that is configured so that it cannot pass through the non-circular aperture when the stake is fully driven into the support surface.

DRAWINGS—FIGURES

Figure 6A:
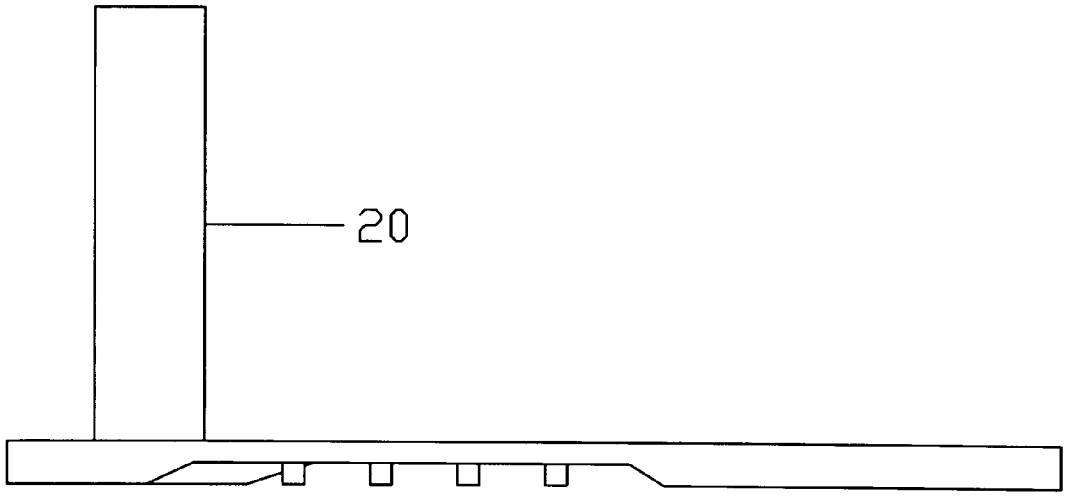
Figure 6B:
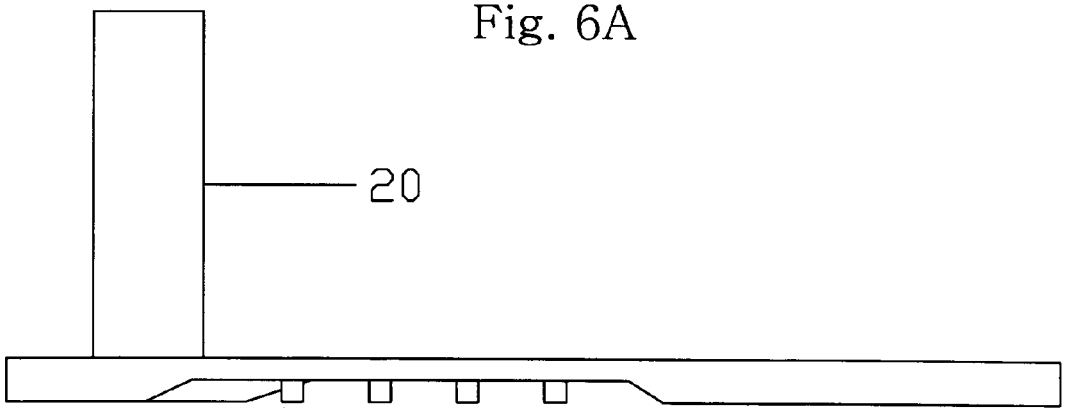
Figure 6C:
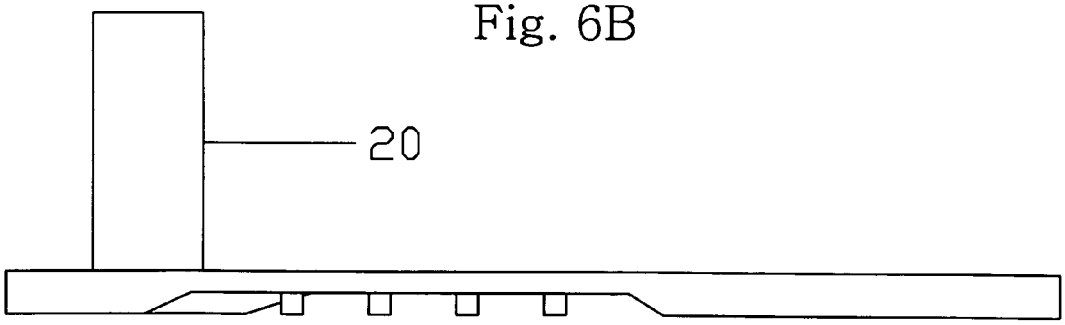

FIGS. 6*a*, 6*b*, and 6*c*, illustrates a side view of the various sizes of the cylinders on my tee apparatus.

DETAILED DESCRIPTION—PREFERRED EMBODIMENTS

Figure 1:
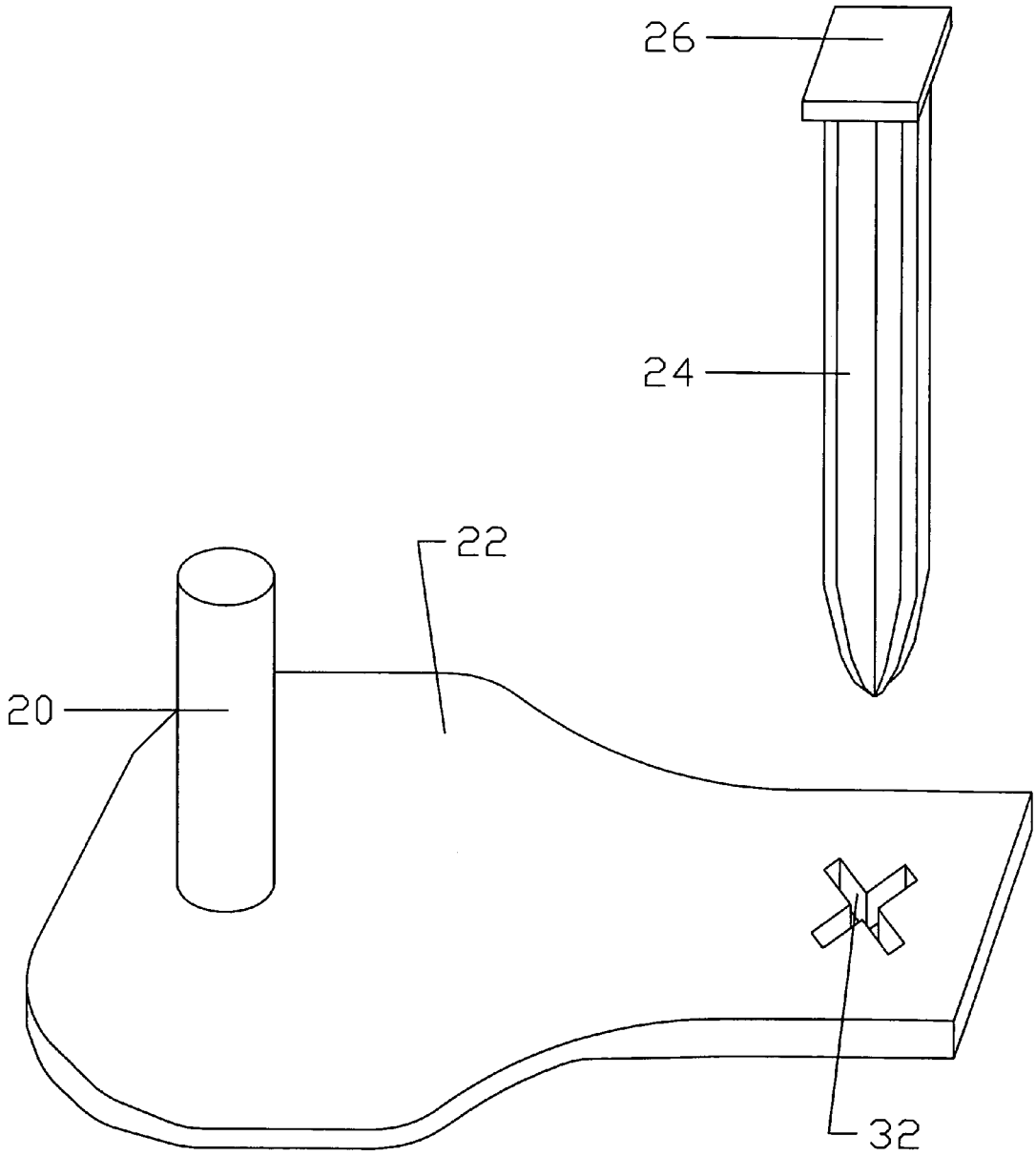
FIG. 1 illustrates an exploded view with the stake detached from the base on my tee apparatus.

A preferred embodiment of the tee apparatus of the present invention is illustrated in FIG. 1 is an exploded view that has a cylinder 20 that consists of soft flexible material. The cylinder 20 is on one end of the base 22. The base 22 is made of soft and flexible material and holds the cylinder 20 upright and has a slot 32 that is opposite the cylinder 20, enabling the stake 24 to go through the base 22 and down into the ground. The stake 24 and slot 32 are both fitted so when connected, the base 22 cannot rotate if the stake 24 is held in place. The stake 24 has a cap 26 to keep it from continuing through the base 22 when the stake 24 is pushed into the base 22 from above.

Figure 2:
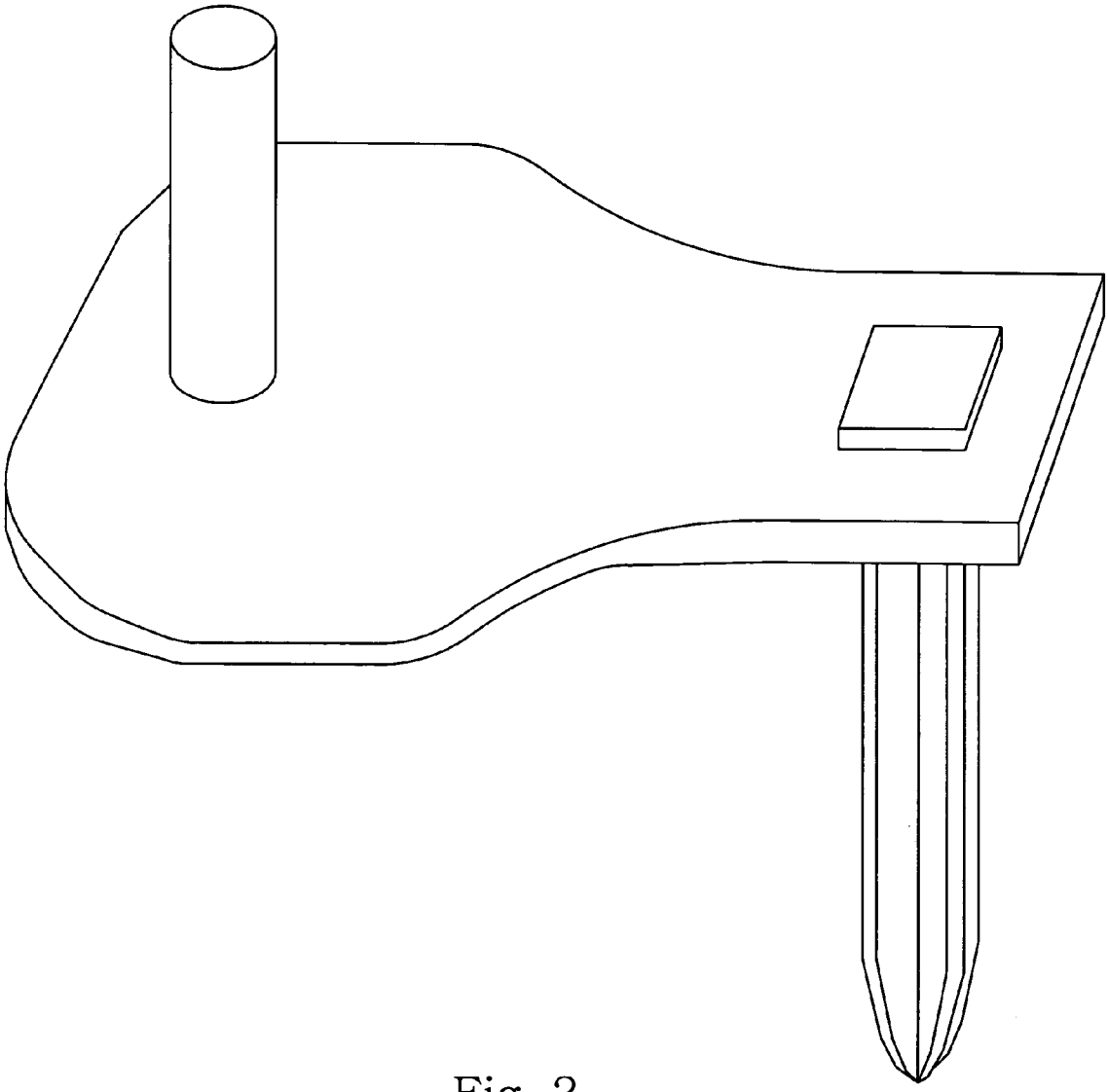
FIG. 2 illustrates a perspective view of my tee apparatus.

FIG. 2 is a perspective view of my tee apparatus.

Figure 3:
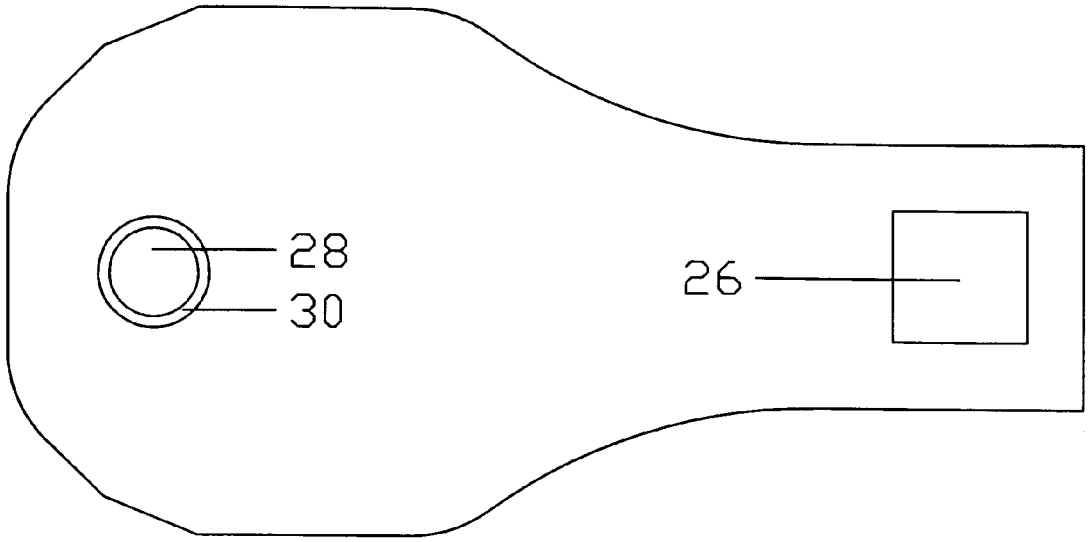
FIG. 3 illustrates a top view of my tee apparatus.

FIG. 3 is a top view of the tee apparatus showing a hollow cylinder 28 and a cylinder wall thickness 30. The top of the cap 26 is also shown here.

Figure 4:
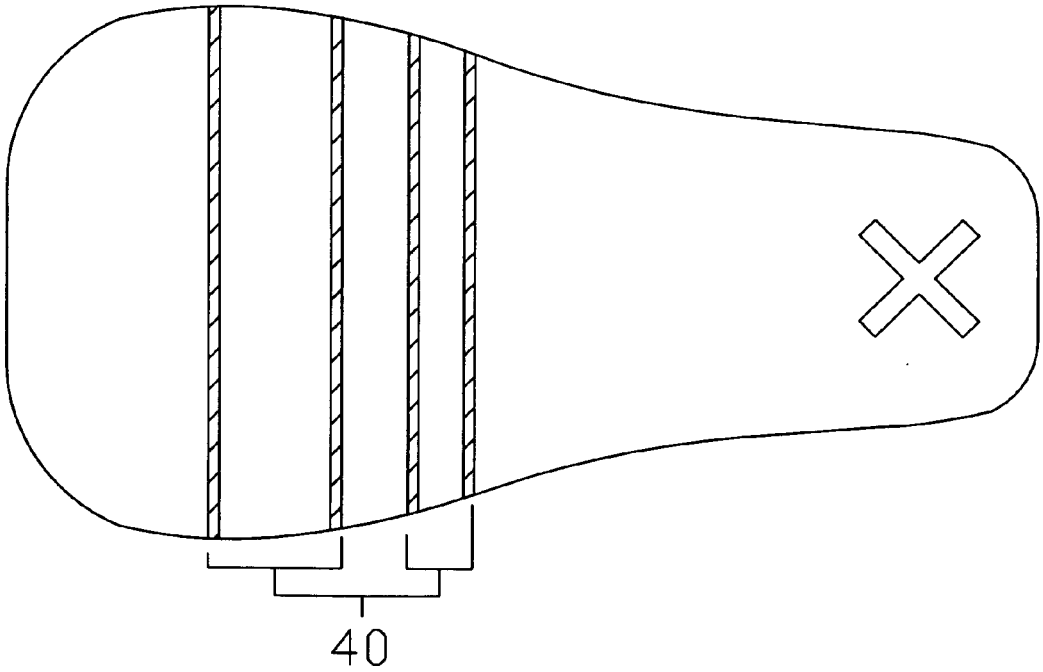
FIG. 4 illustrates a bottom view of the height design to hold the base level on my tee apparatus.

FIG. 4 is a bottom view of the tee apparatus showing it's designs. Certain areas are thicker that will allow the base to lay flat on the ground but still allow it to be thin enough in certain areas to be able to flex when said cylinder 20 in FIG. 1 is struck.

Figure 5:
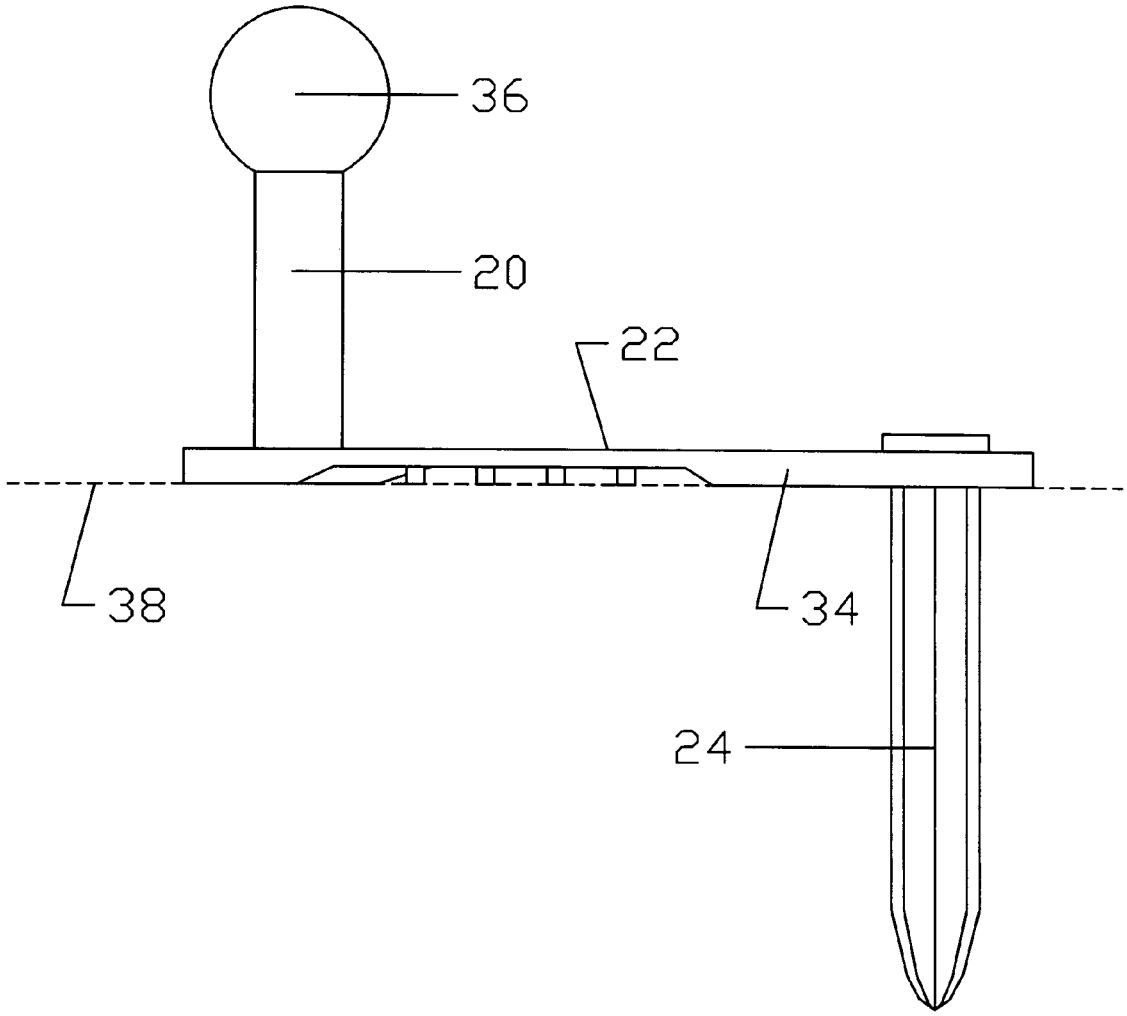
FIG. 5 illustrates a side view of the various sizes of the cylinders on my tee apparatus.

FIG. 5 illustrates a side view showing base thickness 34 and how the cylinder 20 holds a golf ball 36. A ground level 38 is shown where the base 22 lays flat, and the stake 24 penetrates the ground.

ADDITIONAL EMBODIMENTS

FIG. 6*a*, 6*b*, 6*c* shown is the cylinder 20 can be made with various heights to adjust to any size golf club.

Although the description above contains many specifications, these should not be construed as limiting the scope of the invention but merely providing illustrations of some of the presently preferred embodiments of this invention.

For example, the stake can be made in different shapes to hold the base or made in various designs to help the stake stay in the ground. Also, the base can be made with many different designs at the bottom, to help keep it level while it is on the ground.

Thus, the scope of the invention should be determined by the appended claims.

I claim:

1. A golf tee, comprising:

an elongate, flat, flexible base adapted to overlie a support surface;

said flexible base having a longitudinal axis of symmetry;

said flexible base having a first end having a first thickness, a second end longitudinally spaced from said first end and having a thickness substantially equal to said first thickness, and a medial section formed integrally with said first and second ends, said medial section having a thickness that is less than said thickness of said first and second ends;

a flexible, cylindrical tee secured to said first end of said flexible base in upstanding relation thereto, said cylindrical tee being centered on said longitudinal axis of symmetry;

a non-circular aperture formed in said second end of said flexible base, said non-circular aperture being centered on said longitudinal axis of symmetry in longitudinally spaced relation to said flexible, cylindrical tee; and a stake having a cross-section conforming to said non-circular aperture, said stake adapted to be driven into said support surface through said non-circular aperture;

whereby if a golf club head strikes said flexible, cylindrical tee, said medial section of said flexible base will flex so that said flexible, cylindrical tee and said first end of said flexible base will momentarily be lifted from said support surface so that the force of the impact is not fully transferred to said second end so that said second end of said flexible base remains in non-sliding contact with said support surface due to said stake; and whereby said flexible base does not rotate about said stake when said first end of said flexible base is momentarily lifted due to the respective structures of the non-circular aperture and the non-circular stake.

2. The golf tee of claim 1, further comprising:

a plurality of truncate support members disposed in depending relation to an underside of said medial section of said flexible base to prevent sagging of said medial section with respect to said first and second ends of said flexible base.

3. The golf tee of claim 1, further comprising:

said first end of said flexible base having a first width;

said second end of said flexible base having a second width; and said first width being greater than said second width.

4. The golf tee of claim 3, further comprising:

said medial section having a width that tapers from said first width to said second width.

5. The golf tee of claim 1, further comprising:

said stake having a head that is configured so that it cannot pass through said non-circular aperture when said stake is fully driven into said support surface.

* * * * *